United States Patent [19]

O'Lenick, Jr. et al.

[11] Patent Number: 4,731,190

[45] Date of Patent: Mar. 15, 1988

[54] ALKOXYLATED GUERBET ALCOHOLS AND ESTERS AS METAL WORKING LUBRICANTS

[75] Inventors: Anthony J. O'Lenick, Jr., Lilburn; Raymond E. Bilbo, Snellville, both of Ga.

[73] Assignee: Alkaril Chemicals Inc., Winder, Ga.

[21] Appl. No.: 11,771

[22] Filed: Feb. 6, 1987

[51] Int. Cl.[4] ..... C10M 145/38; C10M 173/00; C10M 101/02; C10M 129/66

[52] U.S. Cl. ..... 252/49.3; 252/56 S; 252/52 R; 252/56 R

[58] Field of Search ..... 252/49.3, 56 S, 52 R, 252/56 R

[56] References Cited

U.S. PATENT DOCUMENTS

| | | | |
|---|---|---|---|
| 2,482,761 | 9/1949 | Goebel | 260/407 |
| 2,793,219 | 5/1957 | Barrett et al. | 260/407 |
| 2,793,220 | 5/1957 | Barrett et al. | 260/407 |
| 2,955,121 | 10/1960 | Myers et al. | 260/407 |
| 3,076,003 | 1/1963 | Myers et al. | 260/407 |
| 3,100,784 | 8/1963 | Goebel | 260/407 |
| 3,374,171 | 3/1968 | Davis | 252/49.3 |
| 3,626,559 | 12/1971 | Rossmann et al. | 252/56 R |
| 3,899,433 | 9/1975 | Unick et al. | 252/52 R |
| 3,929,656 | 12/1975 | Flis | 252/56 R |
| 3,945,930 | 3/1976 | Sugiyama et al. | 252/49.5 |
| 4,042,515 | 9/1977 | van Zalm | 252/52 R |
| 4,075,393 | 2/1978 | Sturwold | 252/49.5 |
| 4,099,989 | 7/1978 | Dorsey, Jr. | 252/32 |
| 4,151,099 | 4/1979 | Nassry et al. | 252/56 S |
| 4,243,537 | 1/1981 | Knepp et al. | 252/51.5 A |
| 4,362,634 | 12/1982 | Berens et al. | 252/49.5 |
| 4,425,458 | 1/1984 | Lindner et al. | 524/314 |
| 4,581,152 | 4/1986 | Hotta et al. | 252/49.3 |

FOREIGN PATENT DOCUMENTS

| | | | |
|---|---|---|---|
| 295792 | of 1971 | U.S.S.R. | 252/49.3 |

OTHER PUBLICATIONS

Japanese Patent Abstract 61 01079R.

*Primary Examiner*—William R. Dixon, Jr.
*Assistant Examiner*—Jerry D. Johnson

[57] ABSTRACT

The present invention relates to lubricating compositions useful in facilitating the working of metal. More specifically, the present invention relates to lubricating fluids useful in plastic deformation processes of metals including but not limited to rolling, forging, ironing, drawing and wrinkling.

33 Claims, No Drawings

ALKOXYLATED GUERBET ALCOHOLS AND ESTERS AS METAL WORKING LUBRICANTS

FIELD OF INVENTION

The present invention relates to lubricating compositions useful in facilitating the working of metal. More specifically, the present invention relates to lubricating fluids useful in plastic deformation processes of metals including but not limited to rolling, forging, ironing, drawing and wrinkling.

BACKGROUND

It is well known that water insoluble oils like mineral oil or fatty unsaturated oils are not fully acceptable for working metals from the point of view of cooling efficiency. Early patents like U.S. Pat. No. 3,929,656 to Flis issued Dec. 30, 1975, disclose a typical oil based system made up of 60–90% mineral oil, 5–30% unsaturated fatty oil and 3–15% paraffin oil. Emulsion type lubricants based upon these oils have been used conventionally for plastic deformation processes including but not limited to hot rolling of aluminium, the manufacture of aluminum cans by drawing and ironing, the cold rolling of steel and so forth. These conventional emulsions contain, as an emulsifier, an anionic soap, a nonionic surfactant like a sorbitol ester of alkoxylated alcohol, and other additives. The products used in these processes are typically liquid at ambient temperatures and are of high molecular weight to allow for the needed lubrication properties. In order to get a lubricating material that is effective and liquid, the products of interest have been based upon unsaturated hydrophobes like oleic, linoleic, and tall oil acids. U.S. Pat. No. 3,945,930 to Sugiyma issued Mar. 23, 1976, discloses a typical emulsion system made up of a nonionic fatty acid ethoxylate, an oil soluble unsaturated fatty triglyceride and a corrosion inhibitor based upon a phosphate ester. U.S. Pat. No. 4,042,515 and 4,075,393 describe a dimer acid unsaturated fatty acid ester used in an emulsion system for metal lubrication. Hydrophobic coatings applied to pre-formed aluminum are described in U.S. Pat. No. 4,099,989. U.S. Pat. Nos. 4,243,537, 4,362,634 issued to Behrens et al Dec. 7, 1982 and 4,581,152 describe an unsaturated water dispersible fatty acid alkoxylate and an alkanolamine soap used in drawing compounds.

While these materials function fairly well in most applications, they are subject to an oxidation process referred to as rancidity. The double bond (conjugated or unconjugated) present for the desired liquidity is oxidized to aldehydes and ketones which react to form compounds causing bad color, odor and taste. In applications where a beverage is placed in a drawn can made using an unsaturated synthetic lubricant this is highly undesirable. Even after repeated washing and rinsings, the presence of these unacceptable odor, color and taste components have a profound effect upon these properties at very minute concentrations. Studies have shown that the part per billion levels of some aldehydic compounds causes unacceptable properties in the finished beverage. The beer industry has recently introduced a maximum unsaturation level of 3 mg KOH/gram for any material used in synthetic lubricants. Prior to this invention, the development of useable liquid products with this low level of unsaturation has been unsuccessful.

The compounds and formulations of the present invention are particularly applicable to (but not limited to) cupping, drawing and ironing operations especially in the preparation of aluminum cans. In the manufacture of these cans, the initial operation is referred to as cupping, and involves forming the metal into a cup at pressures of about 22,000 to 22,500 psig. The metal is then redrawn to elongate the sides and afterwards is ironed at pressures of 5,000 psig. This operation is done to increase the length of the sides and decrease the wall thickness. Davis (et al) disclose in U.S. Pat. No. 3,374,171 that the lubricants of higher molecular weight that do not contain unsaturation in the hydrophobe are to be avoided since they will become solid in the emulsion system and subsequently clog the filters used in the processor, or even worse, cause waste treatment problems. The references cited are incorporated by reference.

INVENTION

Until the articles of this invention were developed, the compounds used in the metal can drawing and ironing process were liquid principally by virtue of the unsaturation present in the hydrophobe. The unsaturated components from which liquid lubricants are derived, while successful in giving a liquid product, have several key drawbacks related to the unsaturation. These materials are oxidatively unstable and oxidize at the double bonds to give lower molecular weight aldehydes and ketones and condensation products thereof. The process has been defined as 'rancidity'. The aldehydic products of this process contribute to malodor, off taste and react to give color bodies in the beverage contained within the can. Many manufacturers and canners of beverages, most notably beer have requested that lubricants used to draw, iron, or cup cans have a maximum iodine value of 3 mg KOH/gram. This effectively prevents incorporation of unsaturated materials into a compounded product.

We have found that guerbet alcohols provide a suitable hydrophobe that is liquid for this application. The term guerbet as used here includes guerbet alcohols per se and other beta branched alcohols. These materials have essentially no unsaturation and consequently no iodine value. The alkoxylates and esters of the alkoxylates are excellent can drawing lubricants. These guerbet products conform to the following generic structure:

$$RCH(R')CH_2O(EO)_x(PO)_y(EO)_zR^2$$

wherein R and R' are the same or different saturated aliphatic groups; EO is ethylene oxide: PO is a propylene oxide group; the sum of x, y and z is a positive integer; and $R^2$ is hydrogen or an acyl group —$COR^3$ wherein $R^3$ is an aliphatic moiety. $R^2$ can also be derived from dimer acid and may be a mono or diester.

The value of x is conveniently at least one and the average of x is 1 to about 15. A similar definition exists for y and z. Each of x, y, and z may be zero but the sum must be at least one. The value of z as one shows that the molecule has been capped with ethylene oxide. Ethylene oxide and propylene oxide may be added in blocks or random manner by premixing the oxides.

R is preferably C6 to C16 alkyl and saturated, normal or branched and is derived from a synthetic or natural alcohol.

R′ may be the same or different than R, (ie. C6 to C16 alkyl, normal or branched, synthetic or natural).

$R^2$ is $COR^3$ where $R^3$ is conveniently C4 to C16 alkyl, saturated, normal or branched, synthetic or natural or can be derived from dimer acids as described in U.S. Pat. Nos. 4,075,393 and 4,042,515 or $R^2$=H.

As stated $R^2$ can be derived from dimer acid and may be a mono or diester. Patents describing dimer acids which are prepared by the thermal condensation of unsaturated fatty acids catalyzed by a small amount of montmorillonite clay are described in numerous patents by C. G. Gobel (U.S. Pat. Nos. 2,482,761, 2,793,219, 2,793,220, 2,955,121, 3,076,003, 3,100,784).

A further embodiment of this invention is a composition of an alcohol alkoxylate of the formula $$RCH(R')CH_2O(EO)_x(PO)_y(EO)_zR^2$$

wherein R and R′ are the same or different aliphatic groups; EO is ethylene oxide: PO is propylene oxide; y is 1 or greater z is 0 or greater; $R^2$ is hydrogen or an acyl group —$COR^3$ wherein $R^3$ is an aliphatic moiety.

Another embodiment of the invention is synthetic drawing, cupping, ironing and wrinkling lubricants made up of a mineral oil free emulsion composed of the following:

10–60% Water soluble alkoxylated branched alcohol conforming to the following structure:

$$RCH(R')CH_2O(EO)_x(PO)_y(EO)_zR^2$$

wherein R and R′ are the same or different saturated aliphatic groups; EO is ethylene oxide: PO is a propylene oxide group; the sum of x, y and z is a positive interger; and $R^2$ is hydrogen, 10–40% oil soluble alkoxylated branched alcohol conforming to the following structure:

$$RCH(R')CH_2O(EO)_x(PO)_y(EO)_zR^2$$

wherein R and R′ are the same or different saturated aliphatic groups; EO is ethylene oxide: PO is a propylene oxide group; the sum of x, y and z is a positive interger; and $R^2$ is hydrogen, 0–20% mineral oil or an oil soluble branched alcohol conforming to the following generic structure:

$$RCH(R')CH_2OH$$

wherein R and R′ are the same or different saturated aliphatic groups.

The invention also comprises mixtures of (a) alcohols and esters herein described with (b) water and/or mineral oil or a guerbet alcohol in a ratio of about 20:1 to 1:20.

Guerbet Alcohols have been known since the 1890's when Marcel Guerbet first synthesized these materials (M. Guerbet, C. R. Acad. Sci. Paris, 128, 511; 1002 (1899)). These materials are high in molecular weight and are liquid to very low temperatures. These materials are well suited to be used as raw materials in synthetic lubricants. They are essentially saturated systems.

Guerbet alcohols are high molecular weight, hence;

(1) They have low irritation properties.
(2) They are branched, therefore they are liquid to extremely low temperatures.
(3) They have low volatility.
(4) They are primary alcohols, hence are reactive and can be used to make many derivatives.

Guerbert alcohols are essentially saturated hence;

(1) They exhibit very good oxidative stability at elevated temperatures
(2) They have excellent color initially and at elevated temperatures
(3) They exhibit improved stability over unsaturated products in many formulations.

Fatty esters are generally prepared by reacting a alcohol or an alkoxylated alcohol and a carboxylic acid at elevated temperature. Water is removed from the reaction. The sequence is represented as follows;

GUERBET+ORGANIC ACID→ESTER+WATER

U.S. Pat. No. 4,425,458 to Lindner et al discloses the use of guerbet alcohol diacid esters as plastic lubricants. These esters are not applicable to can drawing and ironing in that they are too hydrophobic. The guerbet must first be alkoxylated to obtain the desired water dispersability and applicability to the drawing process. This is achieved as shown:

GUERBET ALCOHOL+EO and/or PO→GUERBET ALKOXYLATE

EXAMPLES OF GUERBET ALCOHOL

Example #1

Guerbet Alcohol

To 967 grams of decyl alcohol in a suitable reaction flask, add 30.0 grams of potassium hydroxide and 2.0 grams of nickel, under good agitation. Heat material to 250 C. as rapidly as possible. The water generated from the reaction will separate from the refluxing alcohol and is removed from the reaction mass. Refluxing alcohol is returned to the batch.

Reaction progress is followed by GLC analysis. The % $C_{20}$ will exceed 90%. The reaction is then cooled, filtered and distilled to give the commercial guerbet.

Example #2

To 500 grams of decyl alcohol and 500 grams of lauryl alcohol in a suitable reaction flask, add 30.0 grams of potassium hydroxide and 2.0 grams of zinc oxide, under good agitation. Heat material to 250 C. as rapidly as possible. The water generated from the reaction will separate from the refluxing alcohol and is removed from the reaction mass. Refluxing alcohol is returned to the batch.

Reaction progress is followed by GLC analysis. The % guerbet will exceed 90%. The reaction is then cooled, filtered and distilled to give the commercial guerbet.

Example #3

To 500 grams of decyl alcohol and 500 grams of octyl alcohol in a suitable reaction flask, add 30.0 grams of potassium hydroxide and 2.0 grams of nickel, under good agitation. Heat material at 250 C. as rapidly as possible. The water generated from the reaction will separate from the refluxing alcohol and is removed from the reaction mass. Refluxing alcohol is returned to the batch.

Reaction progress is followed by GLC analysis. The % guerbet will exceed 90%. The reaction is then cooled, filtered and distilled to give the commercial guerbet.

Example #4

To 1000 grams of octyl alcohol in a suitable reaction flask, add 30.0 grams of potassium hydroxide and 2.0 grams of nickel, under good agitation. Heat material to 250 C. as rapidly as possible. The water generated from the reaction will separate from the refluxing alcohol and is removed from the reaction mass. Refluxing alcohol is returned to the batch.

Reaction progress is followed by GLC analysis. The % $C_{16}$ will exceed 90%. The reaction is then cooled, filtered and distilled to give the commercial guerbet.

Example #5

To 967 grams of isodecyl alcohol and 500 tridecyl alcohol in a suitable reaction flask, add 30.0 grams of potassium hydroxide and 2.0 grams of nickel, under good agitation. Heat material to 250 C. as rapidly as possible. The water generated from the reaction will separate from the refluxing alcohol and is removed from the reaction mass. Refluxing alcohol is returned to the batch.

Reaction progress is followed by GLC analysis. The % guerbet will exceed 90%. The reaction is then cooled, filtered and distilled to give the commercial guerbet.

Example #6

To 967 grams of coco alcohol in a suitable reaction flask, add 30.0 grams of potassium hydroxide and 2.0 grams of nickel, under good agitation. Heat material to 250 C. as rapidly as possible. The water generated from the reaction will separate from the refluxing alcohol and is removed from the reaction mass. Refluxing alcohol is returned to the batch.

Reaction progress is followed by GLC analysis. The % guerbet will exceed 90%. The reaction is then cooled, filtered and distilled to give the commercial guerbet.

EXAMPLES OF GUERBET ALKOXYLATES

Example #7

To 748.5 grams of alcohol from example 1 is added 2 grams of potassium hydroxide and 249 grams of Ethylene Oxide over a 2 hour period. The material is stripped under vacuum and cooled.

ILLUSTRATIVE EXAMPLES

Using the general procedure outlined the following materials and weight in grams is substituted;

| Example | Alcohol | Ethylene Oxide | Propylene Oxide |
|---|---|---|---|
| 8 | Example 2 748.5 grams | 500 grams | 0 |
| 9 | Example 5 748.5 grams | 250 grams | 250 grams |
| 10 | Example 1 748.5 grams | 0 | 500 grams |
| 11 | Example 6 748.5 grams | 500 grams | 500 grams |

EXAMPLES OF ESTERS

To the amount of alkoxylate specified is added the following amounts of the specified fatty acid. The reaction mixture is heated to 160–180 C. Once the mixture reaches 140 C. water is distilled off. The reaction is continued until the acid value is below 1 mg KOH/-gram.

| Example | Fatty Acid | Alkoxylate Example |
|---|---|---|
| 12 | Octanoic (748.5 grams) | Example #8 (1453 grams) |
| 13 | Lauric (748.5 grams) | Example #9 (2270 grams) |
| 14 | Stearic (748.5 grams) | Example #9 (1613 grams) |
| 15 | Coco (748.5 grams) | Example #10 (1690 grams) |
| 16 | Caprylic (748.5 grams) | Example #11 (155.5 grams) |
| 17 | Dimer Acid (748.5 grams) | Example #11 (238.0 grams) |
| 18 | Dimer Acid (748.5 grams) | Example #11 (119.0 grams) |

Surfactant Properties
Selected Products

| Name | HLB | Molecular Weight |
|---|---|---|
| Alkalube G E-3 (C 20 guerbet 3 EO) | 5 | 430 |
| Oil soluble emulsifier and coupler. | | |
| Alkalube G E-5 (C 20 guerbet 5 EO) | 10 | 518 |
| Water dispersible emulsifier O/W | | |
| Alkalube G E-20 (C 20 guerbet 20 EO) | 15 | 1178 |
| Oil in water emulsifier | | |

FRICTIONAL PROPERTIES

| PRODUCT | DESCRIPTION (22 C) | LUBRICATION DATA 5 Coefficient of Friction FIBER/METAL 100 (m/min) | 300 (m/min) | IODINE VALUE |
|---|---|---|---|---|
| | New Products | | | |
| Alkalube G E-3 | Light Yellow liquid (C 20 guerbet 3 EO) | 0.27 | 0.28 | 0.3 |
| Alkalube G E-5 | Light Yellow liquid (C 20 guerbet 5 EO) | 0.27 | 0.29 | 0.2 |
| Alkalube G E-20 | White paste (C 20 guerbet 20 EO) | 0.27 | 0.32 | 0.1 |
| Example #15 | Yellow liquid | 0.23 | 0.24 | 0.05 |
| Example #16 | Yellow liquid | 0.25 | 0.27 | 0.09 |
| Example #9 | Yellow liquid | 0.27 | 0.28 | 0.11 |

Unsaturated Compounds

| PRODUCT | DESCRIPTION (22 C) | LUBRICATION DATA 5 Coefficient of Friction FIBER/METAL 100 (m/min) | 300 (m/min) | IODINE VALUE |
|---|---|---|---|---|
| Alkasurf TO 8.5 (Polyethyleneglycol 375 talloilate) | Amber oil | 0.38 | 0.35 | 38.6 |
| Alkasurf TO 5.0 (Polyethyleneglycol 220 mono tall oilate) | | 0.38 | 0.42 | 51.3 |
| Tridecyl Oleate | Clear Liquid | 0.25 | 0.27 | 43.3 |
| TMP Trioleate | Clear Amber Liquid | 0.25 | 0.35 | 78.6 |

RANCIDITY TESTING
(Addition of 1% product to water stored for 3 months)
20 C

| Material | Aldehyde (Head Space analysis) | Odor | Taste |
|---|---|---|---|
| Alkalube G E-3 | None Detected | Good | Good |
| Alkalube G E-5 | None Detected | Good | Good |
| Alkalube G E-20 | None Detected | Good | Good |

RANCIDITY TESTING
(Addition of 1% product to water stored for 3 months)
Unsaturated Compounds

20 C

| Material | Aldehyde (Head Space analysis) | Odor | Taste |
|---|---|---|---|
| Alkasurf TO 8.5 | 80 ppm | Fair | Fair |
| Alkasurf TO 5.0 | 100 ppm | Poor | Fair |
| Tridecyl Oleate | 90 ppm | Fair | Fair |
| TMP Trioleate | 120 ppm | Poor | Poor |

50 C

| Material | Aldehyde (Head Space) | Odor | Taste |
|---|---|---|---|
| Alkalube G E-3 | None Detected | Good | Good |
| Alkalube G E-5 | None Detected | Good | Good |
| Alkalube G E-20 | None Detected | Good | Good |

Unsaturated Compounds

| Material | Aldehyde (Head Space analysis) | Odor | Taste |
|---|---|---|---|
| Alkasurf TO 8.5 | 200 ppm | Poor | Poor |
| Alkasurf TO 5.0 | 175 ppm | Poor | Fair |
| Tridecyl Oleate | 220 ppm | Poor | Poor |
| TMP Trioleate | 210 ppm | Poor | Poor |

10 C

| Material | Aldehyde (Head Space analysis) | Odor | Taste |
|---|---|---|---|
| Alkalube G E-3 | None Detected | Good | Good |
| Alkalube G E-5 | None Detected | Good | Good |
| Alkalube G E-20 | None Detected | Good | Good |

Unsaturated Compounds

| | | | |
|---|---|---|---|
| Alkasurf TO 8.5 | 70 ppm | Fair | Fair |
| Alkasurf TO 5.0 | 80 ppm | Fair | Fair |
| Tridecyl Oleate | 80 ppm | Fair | Fair |
| TMP Trioleate | 85 ppm | Fair | Poor |

Generally, the use of the guerbet compounds described herein is by spraying or dipping or otherwise applying sufficient amount of the previously described materials onto the metal surface to be treated. The amount of the compound applied depends on the operation and the temperature of the metal during the operation. Conveniently, from 0.0001 gram to 1 gram of product per one kg of the metal is employed.

What is claimed is:

1. A process for forming a metal container including processing the metal in at least one of the operations including drawing, cupping, forging, ironing, rolling, wrinkling or canning by contacting the metal with a sufficient amount of the guerbet composition of the formula $$RCH(R')CH_2O(EO)_x(PO)_y(EO)_zR^2$$

wherein R and R′ are the same or different saturated aliphatic groups; EO is ethylene oxide; PO is a propylene oxide group; the sum of x, y and z is a positive integer; and $R^2$ is hydrogen or an acyl group —$COR^3$ wherein $R^3$ is an aliphatic moiety to reduce the friction in the operation.

2. The process of claim 1 wherein y is at least one.

3. The process of claim 1 wherein R and R′ are the same.

4. The process of claim 1 wherein $R^2$ is hydrogen.

5. The process of claim 1 wherein $R^3$ is alkyl.

6. The process of claim 1 wherein $R^3$ is branched.

7. The process of claim 1 wherein x or y averages from 1 to about 15.

8. The process of claim 1 wherein $R^2$ is a mixture of hydrogen and acyl.

9. The process of claim 1 wherein the groups R and R′ are both alkyl and contain about 6 to about 16 carbon atoms each.

10. The process of claim 1 wherein $R^3$ is an acyl group derived from a dimer acid giving a mono or diester.

11. The process of claim 1 wherein x or y averages from 1 to about 1.

12. The process of claim 1 wherein y is 0.

13. The process of claim 1 wherein z is at least 1.

14. The process of claim 1 using the guerbet composition and water at a weight ratio of from about 20:1 to about 1:20.

15. The process of claim 1 additionally comprising water and mineral oil.

16. The process of claim 15 using mineral oil and the guerbet composition in about a 20:1 to about 1:20 weight ratio.

17. The process of claim 1 wherein the guerbet composition has been diluted with water.

18. The process of claim 1 wherein the guerbet composition has been diluted with mineral oil.

19. The process of claim 1 wherein x is at least one.

20. The process of claim 19 wherein y is at least 1.

21. The process of claim 20 wherein z is at least 1.

22. The process of claim 1 using an alcohol alkoxylate of the formula $$RCH(R')CH_2O(PO)_y(EO)_zR^2$$

wherein R and R′ are the same or different aliphatic groups; EO is ethylene oxide; PO is propylene oxide; y is 1 or greater z is 0 or greater; $R^2$ is hydrogen or an acyl group —$COR^3$ wherein $R^3$ is aliphatic.

23. The process of claim 22 wherein R and R′ are saturated.

24. The process of claim 22 wherein R and R′ are the same.

25. The process of claim 22 wherein $R^2$ is hydrogen.

26. The process of claim 22 wherein z averages from 1 to about 15.

27. The process of claim 22 using mineral oil and guerbet composition in a weight ratio of from about 20:1 to about 1:20.

28. The process of claim 22 using water and the guerbet composition at a weight ratio of 20:1 to 1:20.

29. The process of claim 22 additionally comprising water and mineral oil.

30. The process of claim 22 wherein the alcohol alkoxylate has been diluted with water.

31. The process of claim 22 wherein the alcohol alkoxylate has been diluted with mineral oil.

32. The process of claim 22 wherein y averages from about 1 to about 15.

33. The process of claim 32 wherein z averages from 1 to about 15.

* * * * *